US005803237A

United States Patent [19]

Gandre et al.

[11] Patent Number: 5,803,237

[45] Date of Patent: Sep. 8, 1998

[54] PUSHBUTTON SWITCH WITH DISABLING CAPABILITY

[76] Inventors: Jerry D. Gandre, 7408 Curly Leaf Cove, Austin, Tex. 78750; Steven Sands, 11509 Shade Tree Cove, Austin, Tex. 78759; Timothy C. Dearborn, 12804 Bivins Ct., Austin, Tex. 78732

[21] Appl. No.: 739,341

[22] Filed: Oct. 29, 1996

[51] Int. Cl.[6] ..... H01H 9/28

[52] U.S. Cl. ..... 200/43.01; 200/43.16; 200/341

[58] Field of Search ..... 200/43.01, 43.16, 200/43.18, 43.19, 43.21, 345, 341, 344, 517

[56] References Cited

U.S. PATENT DOCUMENTS

| | | | |
|---|---|---|---|
| 4,134,279 | 1/1979 | Ross et al. | 70/18 |
| 4,503,582 | 3/1985 | Gurubatham | 16/232 |
| 4,718,261 | 1/1988 | Kunz | 70/428 |
| 4,912,599 | 3/1990 | Wittmer | 361/378 |
| 5,268,545 | 12/1993 | Bruner | 200/344 |
| 5,329,080 | 7/1994 | Pierce et al. | 200/5 B |
| 5,590,020 | 12/1996 | Sellers | 200/341 |

*Primary Examiner*—David J. Walczak
*Attorney, Agent, or Firm*—Skjerven, Morrill, MacPherson, Franklin & Friel; M. Kathryn Braquet Tsirigotis

[57] ABSTRACT

The pushbutton switch of the present invention includes one or more normally open contact switches and a moveable base plate having a handle and moveable to either a disabled or an operational position by a force applied to the handle. One or more pushbuttons are included wherein each pushbutton is individually depressable to operate a respective one of said normally open contact switches to a closed condition when the moveable base plate is in the operational position. A cover plate having apertures corresponding to the pushbuttons and to the handle of the moveable base plate is included wherein the pushbuttons and the handle are accessible through the apertures. Two or more fasteners are used to slideably couple the moveable base plate to the cover plate. One or more detents are used to hold the moveable base plate in either the disabled or the operational position.

11 Claims, 5 Drawing Sheets

PUSHBUTTON SWITCH WITH DISABLING CAPABILITY

BACKGROUND OF THE INVENTION

1. Field of the Invention

This invention relates to pushbutton switches of the type wherein one or more pushbuttons are depressable to operate respective individual contact switches.

2. Description of the Related Art

In personal computer systems, electronic devices and the like, it is desirable to provide a means for preventing accidental activation of the power and reset buttons (or other buttons) on a computer system. Important design considerations are ease of use and minimizing the number of physical parts to accomplish power and reset functions while allowing protection from accidental activation. Various techniques have been used to solve the problem of preventing accidental activation of the power and reset functions in a computer system, such as, disabling the power and reset switch functions via software, programming a delay to the power and reset switches, or various mechanical means for preventing accidental switch activation.

These techniques have certain drawbacks, for instance, if the power and/or reset function is disabled via software on the computer system, access to a keyboard and display is required to re-enable the reset or power down functions. Another technique requires confirmation via software and the user must push another button (the "enter" button, for example) in addition to the power down or reset button. This technique is used effectively only when a keyboard is near the power down or reset buttons. Additional cost is usually involved to provide this level of functionality. Another method of preventing accidental activation of the power and reset functions is to program a delay to the power and reset switches so that the user must depress the pushbutton for a period of time (for instance, five seconds) before response occurs. This technique has been used on portable computer systems such as notebooks. It is not effective if something touches the button and holds it in accidentally, not intending to reset or shut the computer down. It also requires the user to know about the delay so that the user does not think that the switches are not working.

There are numerous examples of mechanical techniques for preventing a switch pushbutton from accidentally activating. Some examples include the use of a protective cover, either covering the switch or a majority of the front of the computer, for example, a big access door, or a clear cover with an access opening that requires the user to use a pointed object such as a pencil to depress the pushbutton switch. Another example utilizes a rotateable button wherein rotating the button one way locks travel and inhibits actuation and rotating the button the other way unlocks the switch. Another technique utilizes recessed pushbuttons for preventing accidental activation which can be difficult to use. Some of these mechanical techniques have been found to be difficult to use or involve a large number of parts which can be impracticable where, for instance, the protective cover ends up lost or thrown away by the customer or in some cases easily broken.

Important design considerations in preventing accidental activation of computer systems and other similar electronic devices are reliability, cost effectiveness, simplicity and ease of use. The present invention, which provides power and reset functions while allowing protection from accidental activation, has the advantages of reliability and the simplicity of a minimum number of physical parts which also provides cost effectiveness and ease of use.

SUMMARY OF THE INVENTION

The pushbutton switch of the present invention includes one or more normally open contact switches and a moveable base plate having a handle and moveable to either a disabled or an operational position by a force applied to the handle. One or more pushbuttons are included wherein each pushbutton is individually depressable to operate a respective one of said normally open contact switches to a closed condition when the moveable base plate is in the operational position. A cover plate having apertures corresponding to the pushbuttons and to the handle of the moveable base plate is included wherein the pushbuttons and the handle are accessible through the apertures. Two or more fasteners are used to slideably couple the moveable base plate to the cover plate. One or more detents are used to hold the moveable base plate in either the disabled or the operational position.

In one embodiment of the invention, the pushbuttons are integral to the moveable base plate which is disposed adjacent to the cover plate. The moveable base plate includes apertures adjacent to each pushbutton wherein, when the moveable base plate is in the disabled position, the aperture clears the respective contact switch and the contact switch remains in an open condition when the pushbutton is depressed.

In a second embodiment of the invention, the pushbuttons are integral to the moveable base plate which is recessed a distance from the cover plate. When the moveable base plate is in the disabled position the pushbuttons are in an inaccessible position adjacent to the apertures in the cover plate and are no longer depressable to operate the respective contact switches.

In a third embodiment of the present invention, the pushbuttons are attached to a support plate in a flexible manner, and the support plate is disposed adjacent to the cover plate in a fixed position. The moveable base plate is slideably disposed adjacent to the support plate on the side opposite the cover plate and includes either depressable tabs or apertures corresponding to each pushbutton. When the moveable base plate is in the operational position each pushbutton is depressable to operate the respective contact switch to a closed condition. When the moveable base plate is in the disabled position, the tabs or apertures are juxtapositionally adjacent to each pushbutton wherein the pushbuttons are not depressible and the respective contact switch remains in an open condition.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENTS

Figure 1:
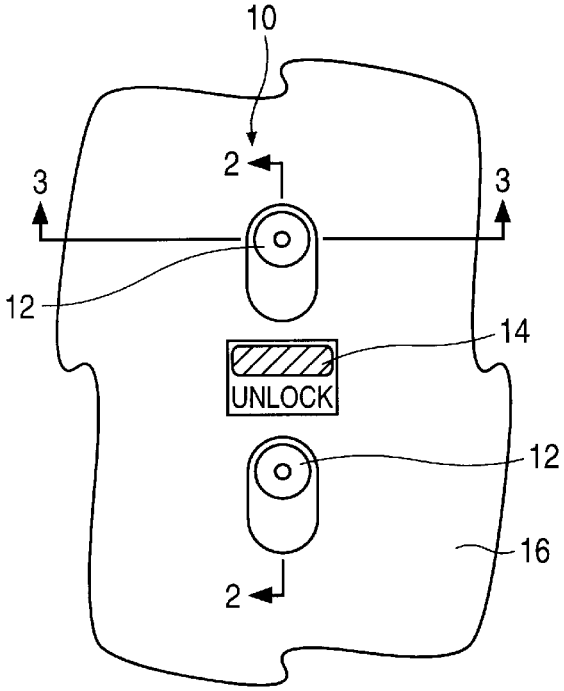
FIG. 1 is a schematic front view of a first embodiment of the present invention illustrating the cover plate, the pushbuttons and the handle of the moveable base plate.

In the description which follows, like parts are marked throughout the specification and drawings with the same reference numerals, respectively. The drawing figures are not necessarily to scale, and certain features of the invention may be shown exaggerated in scale in the interest of clarity and conciseness.

Figure 2A:
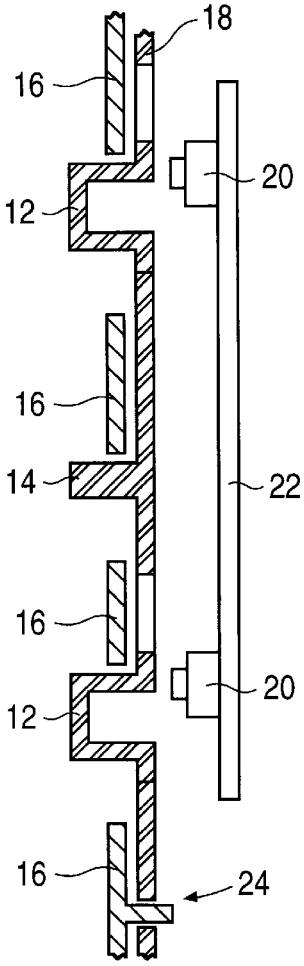
FIGS. 2A AND 2B are section views taken along line 2—2 of FIG. 1 illustrating the first embodiment of the present invention wherein the moveable base plate is in the operational position (FIG. 2A) and wherein the moveable base plate is in the disabled position (FIG. 2B)
Figure 2B:
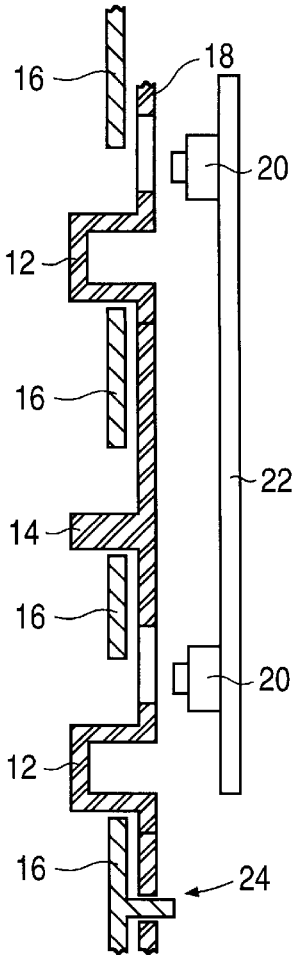

Referring now to FIG. 1, a schematic front view of a first embodiment of the pushbutton switch 10 of the present invention is illustrated. FIG. 1 illustrates a cover plate 16 having apertures corresponding to each of one or more pushbuttons 12 and an aperture corresponding to a handle 14 of a moveable base plate wherein the pushbuttons 12 and the handle 14 are accessible through the apertures. The moveable base plate is moveable by a force applied to the handle to either a disabled position, also referred to as a locked position, or an operational position, also referred to as an unlocked position. FIG. 2A and FIG. 2B are sectional views taken along the line 2—2 of FIG. 1, wherein the moveable base plate 18 is shown in the operational position (FIG. 2A) and the disabled position (FIG. 2B). The cover plate 16 includes apertures wherein the pushbuttons 12 are accessible through the apertures in the cover plate 16. The pushbuttons 12 are an integral part of the moveable base plate 18. In FIG. 2A, the moveable base plate 18 is in the operational position wherein the pushbuttons 12 are individually depressible to operate a respective one of normally open contact switches 20. The contact switches 20 are, for instance, attached to a printed circuit board 22. In this first embodiment of the present invention, the moveable base plate 18 has an aperture disposed adjacent each pushbutton 12 wherein, when the moveable base plate 18 is in the disabled position, as illustrated in FIG. 2B, the aperture clears the respective contact switch 20 and the contact switch 20 remains in an open condition when the pushbutton 12 is depressed. One or more detents 24 hold the moveable base plate 18 in either the disabled or operational position.

Figure 3:
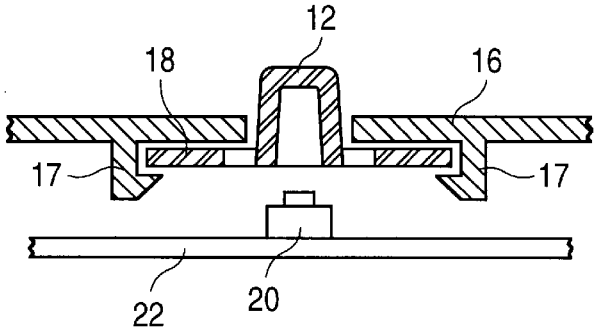
FIG. 3 is a section view taken along line 3—3 of FIG. 1.

FIG. 3 is a sectional view taken along line 3—3 of FIG. 1. The moveable base plate 18 is slideably coupled to the cover plate 16 through the use of two or more fasteners 17, such as the snap fingers shown for example.

Figure 4A:
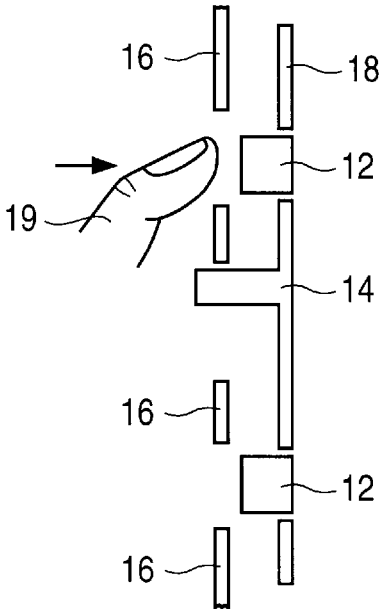
FIGS. 4A AND 4B are schematic views illustrating a second embodiment of the present invention wherein the moveable base plate is in the operational position (FIG. 4A) and the disabled position (FIG. 4B)
Figure 4B:
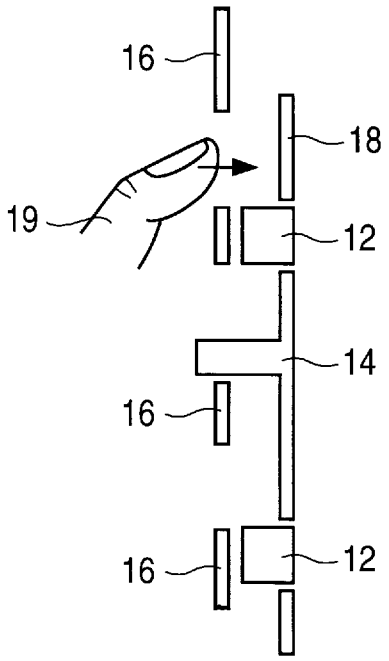

FIG. 4A and FIG. 4B are schematic views illustrating a second embodiment of the present invention wherein the moveable base plate 18 is recessed a distance from the cover plate 16. The moveable base plate 18 is illustrated in the operational position in FIG. 4A and in the disabled position in FIG. 4B. The pushbuttons 12, which are an integral part of the moveable base plate 18, are accessible to a user 19 through the apertures in the cover plate 16 when the moveable base plate 18 is in the operational position (see FIG. 4A). When the moveable base plate 18 is in the disabled position, the pushbuttons 12 are in an inaccessible position adjacent to the apertures in the cover plate 16 and are no longer depressable to operated the respective contact switches (not shown in this figure).

Figure 5:
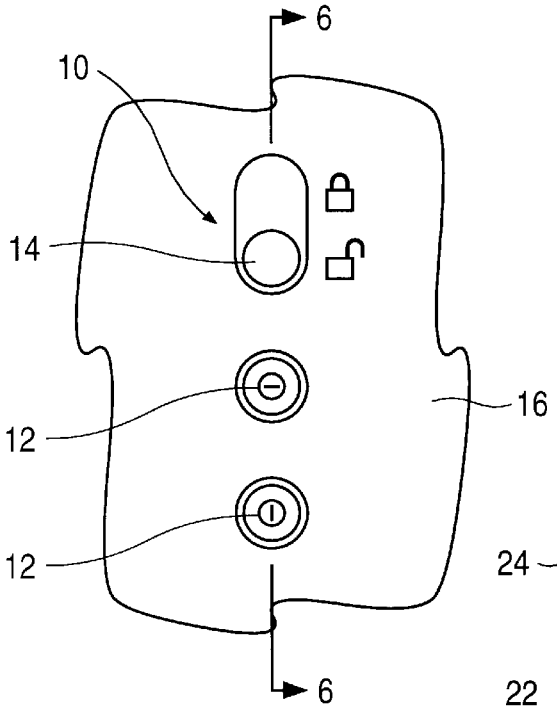
FIG. 5 is a schematic front view of a third embodiment of the present invention illustrating the cover plate, the pushbuttons and the handle of the moveable base plate.

Referring now to FIG. 5, a schematic front view of a third embodiment of the pushbutton switch 10 of the present invention is illustrated. FIG. 5 shows the cover plate 16 having apertures through which the pushbuttons 12 and the handle 14 to the moveable base plate are accessible.

Figure 6A:
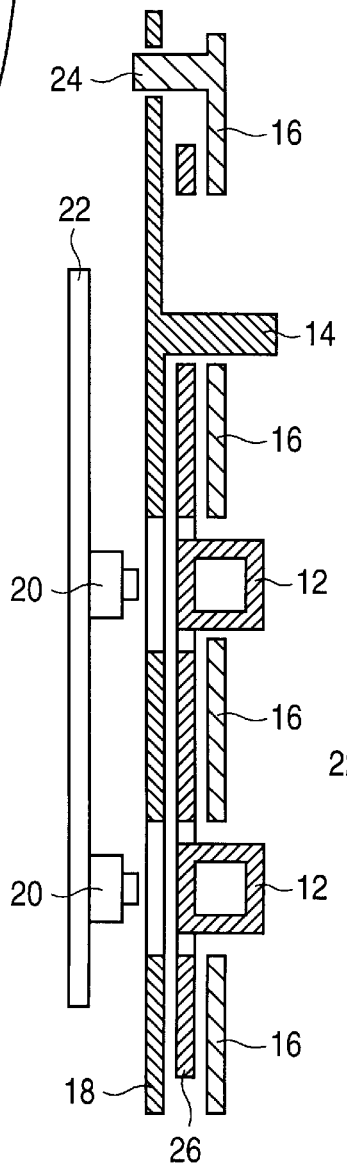
FIGS. 6A AND 6B are section views taken along line 6—6 of FIG. 5 illustrating the moveable base plate in the operational position (FIG. 6A) and in the disabled position (FIG. 6B)
Figure 6B:
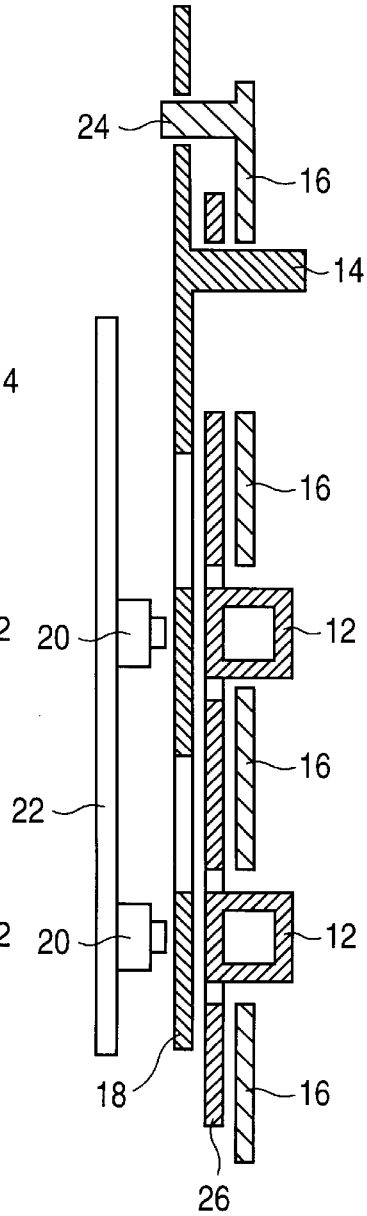

FIG. 6A and FIG. 6B illustrate sectional views of the third embodiment of the present invention taken along line 6—6 of FIG. 5, wherein the moveable base plate 18 is shown in the operational position (FIG. 6A) and in the disabled position (FIG. 6B). The third embodiment of the present invention includes a support plate 26 disposed adjacent to the cover plate 16 in a fixed position wherein the pushbuttons 12 are attached in a flexible manner to the support plate 26 rather than the moveable base plate 18. The moveable base plate 18 is slideably disposed adjacent to the support plate 26 on the side opposite the cover plate 16 and fasteners, such as snap fingers (illustrated and described in FIG. 7A) slidably couple the moveable base plate 18 to the cover plate 16. The moveable base plate 18 is moveable to either the disabled or the operational position by a force applied to the handle 14. The moveable base plate 18 has apertures corresponding to each pushbutton 12 wherein when the moveable base plate 18 is in an operational position (see FIG. 6A) each pushbutton 12 is individually depressible to operate the respective normally open contact switch 20 to a closed condition. The contact switches 20 are, for instance, attached to a printed circuit board 22. The moveable base plate 18 also may include depressible tabs (not shown) corresponding to each pushbutton 12 wherein each pushbutton 12 and corresponding tab (not shown) is depressible to operate the respective contact switch 20 to a closed condition when the moveable base plate 18 is in the operational position.

FIG. 6B illustrates the moveable base plate 18 in the disabled position wherein the corresponding apertures (or depressible tabs (not shown)) are juxtapositionally adjacent to each pushbutton 12 wherein the pushbutton 12 is not depressible and the respective contact switch 20 remains in an open condition. The moveable base plate 18 is held in either the disabled or the operational position by one or more detents 24 The detent 24 includes a catch section on the moveable base plate 18 and a spike section on the cover plate 16. Although not illustrated for all embodiments, one or more detents are used, for example, with each of the embodiments of the present invention.

Figure 7A:
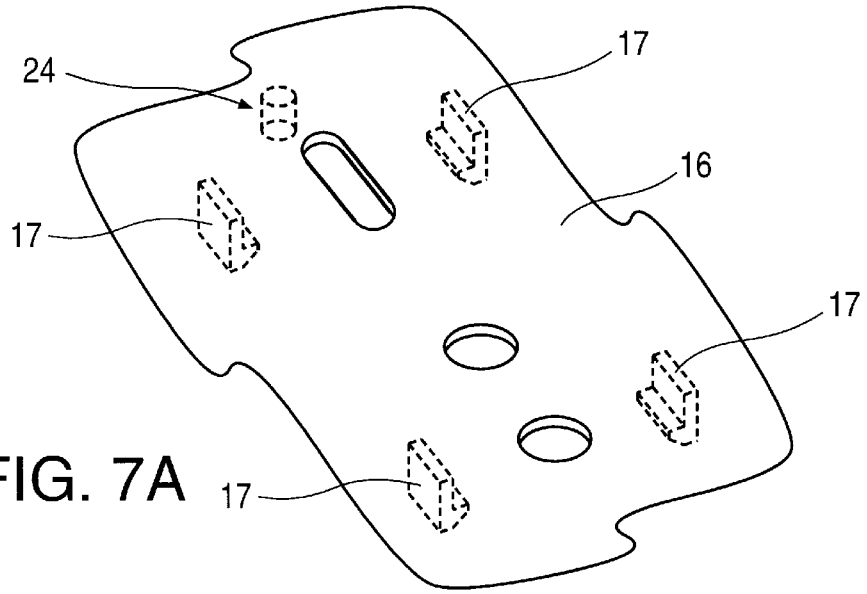
FIGS. 7A–7C show an exploded view of the third embodiment of the present invention illustrating the cover plate (FIG. 7A), the pushbuttons and support plate (FIG. 7B) and the moveable base plate with apertures (FIG. 7C)
Figure 7B:
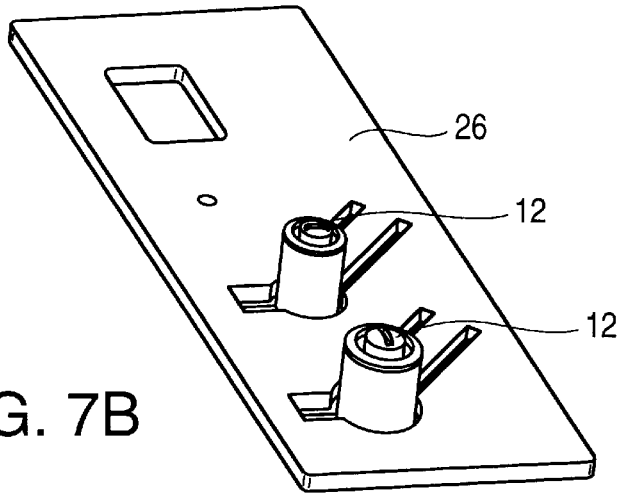
Figure 7C:
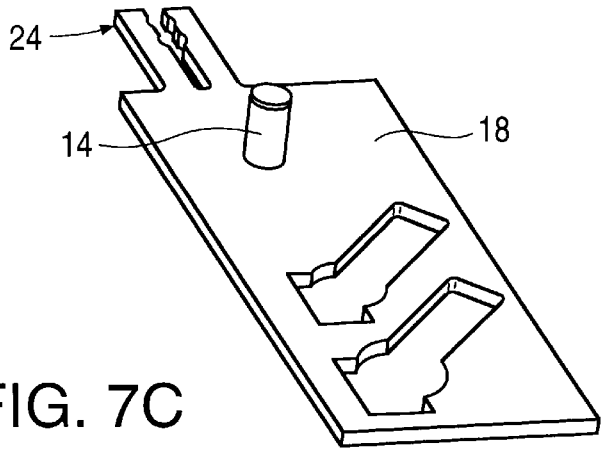

FIG. 7A, FIG. 7B and FIG. 7C illustrate an exploded view of the assembly of the third embodiment of the present invention. FIG. 7A shows the cover plate 16 with apertures for the pushbuttons 12 and handle 14 of the moveable base plate 18. Also shown is a hidden line view of the fasteners 17, such as the snap fingers shown, used to slideably couple the moveable base plate 18 to the cover plate 16. In the third embodiment, the fasteners 17 also hold the support plate 26 adjacent to the cover plate 16 in a fixed position and the moveable base plate 18 is slideably disposed adjacent to the support plate 26 on the side opposite the cover plate 16 (see FIGS. 6A and 6B). FIG. 7B illustrates the pushbuttons 12 attached in a flexible manner to the support plate 26. FIG. 7C shows the moveable base plate 18 including the handle 14 and apertures corresponding to each of the pushbuttons 12. Also shown is the detent 24 for holding the moveable base plate 18 in either the disabled position or the operational position.

Figure 8:
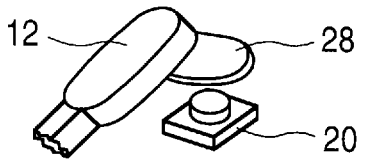
FIG. 8 is a perspective view illustrating an optional pushbutton including an actuation tab which may be used with any of the embodiments of the present invention.

FIG. 8 is a perspective view of a pushbutton 12, having an actuation tab section 28 to operate the respective contact switch 20. A conventional circular or cylindrical pushbutton (as illustrated in previous figures) or the pushbutton 12 illustrated in FIG. 8 may be used, for instance, in any of the embodiments of the present invention.

Figure 9:
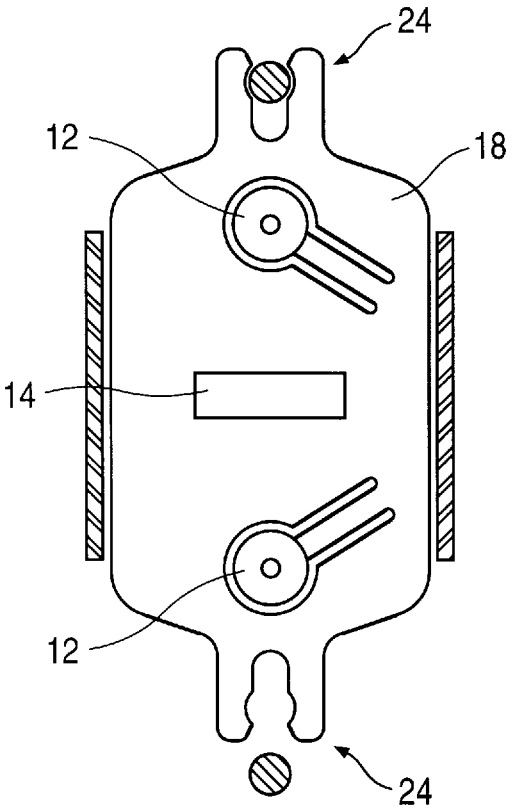
FIG. 9 is an elevation view illustrating an optional detent technique which may be used with any of the embodiments of the present invention.

FIG. 9 is an elevation view illustrating an optional detent technique for holding the moveable base plate 18 in either the disabled position or the operational position. FIG. 9 illustrates a detent 24 on both the upper and lower ends of the moveable base plate 18 of the first embodiment of the present invention, illustrated herein with the handle 14 and pushbuttons 12 integral to the moveable base plate 18. Two fasteners 17, such as the elongated snap fingers shown for instance, slideably couple the moveable base plate 18 to the cover plate (not shown in this figure). Another option is to locate a plurality of detents laterally on the moveable base plate and integral to the fasteners (not shown). Although not illustrated for all embodiments, any of a variety of detent techniques may be used with each of the embodiments of the present invention.

Figure 10:
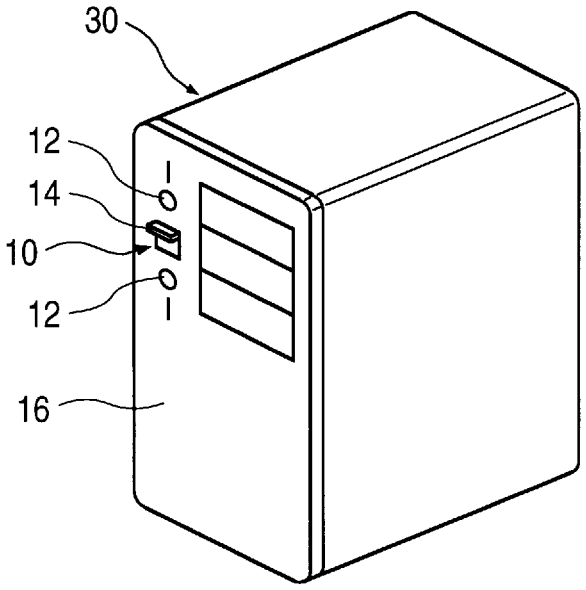
FIG. 10 is a perspective view illustrating a computer system including the pushbutton switch of the first embodiment of the present invention.

FIG. 10 is a perspective view illustrating a computer system 30 including the pushbutton switch 10 of the present invention showing the cover plate 16 with apertures through which the pushbuttons 12 and handle 14 of the moveable base plate are accessible to the user.

While there has been illustrated and described particular embodiments of the present invention, it will be appreciated that numerous changes and modifications will occur to those skilled in the art, and it is intended in the appended claims to cover all those changes and modifications which fall within the true spirit and scope of the present invention.

The present invention accomplishes power and reset functions while allowing protection from accidental activation utilizing a minimum number of physical parts which allows for reliability and ease of use not previously available. The pushbutton switch of the present invention allows for selection of a disabled versus operational mode independent of software settings and therefore independent of access to a keyboard and display which provides for ease of use.

Other embodiments are within the following claims, and, while only certain preferred features of the invention have been shown by way of illustration, many modifications and changes will occur. It is therefore to be understood that the present claims are intended to cover all such modifications and changes which fall within the true spirit of the invention.

What is claimed is:

1. A pushbutton switch comprising:

one or more normally open contact switches;

a moveable base plate having a handle, wherein said moveable base plate is moveable to either a disabled or an operational position by a force applied to the handle;

one or more pushbuttons, each pushbutton individually depressable to operate a respective one of said normally open contact switches to a closed condition when said moveable base plate is in the operational position;

a cover plate having apertures therein corresponding to the one or more pushbuttons and to the handle of the moveable base plate wherein the one or more pushbuttons and the handle are accessible through the apertures;

a support plate disposed adjacent to the cover plate in a fixed position wherein the one or more pushbuttons are attached to the support plate in a flexible manner; and two or more fasteners slideably coupling the moveable base plate to the cover plate.

2. A pushbutton switch according to claim 1 further comprising:

one or more detents for holding the moveable base plate in either the disabled or the operational position.

3. A pushbutton switch according to claim 1 wherein one said pushbutton operates a power switch.

4. A pushbutton switch according to claim 1 wherein one said pushbutton operates a reset switch.

5. A pushbutton switch according to claim 1 wherein the one or more pushbuttons have an actuation tab section to operate the respective contact switch.

6. A pushbutton switch according to claim 1 wherein the two or more fasteners are snap finger fasteners.

7. A pushbutton switch comprising:

one or more normally open contact switches;

a support plate;

one or more pushbuttons attached to the support plate in a flexible manner, a moveable base plate having a handle, wherein said moveable base plate is moveable to either a disabled or an operational position by a force applied to the handle and wherein said moveable base plate includes apertures corresponding to each pushbutton wherein each pushbutton is individually depressable to operate a respective one of said normally open contact switches to a closed condition when said moveable base plate is in the operational position;

a cover plate having apertures therein corresponding to the one or more pushbuttons and to the handle of the moveable base plate wherein the one or more pushbuttons and the handle are accessible through the apertures and wherein the support plate is disposed adjacent the cover plate in a fixed position; and two or more fasteners slideably coupling the moveable base plate to the cover plate wherein the moveable base plate is slideably disposed adjacent to the support plate on the side opposite the cover plate.

8. A pushbutton switch according to claim 7 wherein, when said moveable base plate is in the disabled position, the corresponding apertures are juxtapositionally adjacent each pushbutton wherein the one or more pushbuttons are not depressable and the respective contact switches remain in an open condition.

9. A pushbutton switch according to claim 7 further comprising:

one or more detents for holding the moveable base plate in either the disabled or the operational position.

10. A computer system including a pushbutton switch for activation of power and reset functions comprising:

one or more normally open contact switches;

a moveable base plate having a handle, wherein said moveable base plate is moveable to either a disabled or an operational position by a force applied to the handle;

one or more pushbuttons, each pushbutton individually depressable to operate a respective one of said normally open contact switches to a closed condition when said moveable base plate is in the operational position;

a cover plate having apertures therein corresponding to the one or more pushbuttons and to the handle of the moveable base plate wherein the one or more pushbuttons and the handle are accessible through the apertures;

a support plate disposed adjacent to the cover plate in a fixed position wherein the one or more pushbuttons are attached to the support plate in a flexible manner; and two or more fasteners slideably coupling the moveable base plate to the cover plate.

11. A computer system according to claim 1 further comprising:

one or more detents for holding the moveable base plate in either the disabled or the operational position.

* * * * *